US005489057A

United States Patent [19]

Deschenes

[11] Patent Number: 5,489,057

[45] Date of Patent: Feb. 6, 1996

[54] FABRICATION OF NEEDLES USEFUL IN THE DISPENSING OF PLASTIC FASTENERS

[75] Inventor: Charles L. Deschenes, North Attleboro, Mass.

[73] Assignee: Avery Dennison Corporation, Pasadena, Calif.

[21] Appl. No.: 130,292

[22] Filed: Oct. 1, 1993

[51] Int. Cl.[6] ..... B65C 7/00

[52] U.S. Cl. ..... 227/67; 76/101.1; 205/73; 428/586

[58] Field of Search ..... 76/101.1, 119; 205/67, 73; 227/67; 428/586

[56] References Cited

U.S. PATENT DOCUMENTS

| | | | |
|---|---|---|---|
| 3,607,674 | 9/1971 | Lauritzen | 205/73 |
| 4,326,928 | 4/1982 | Dugan | 205/73 |
| 4,664,758 | 5/1987 | Grey | 205/73 |
| 4,955,475 | 9/1990 | McCarthy et al. | 40/664 |

*Primary Examiner*—Rinaldi I. Rada
*Attorney, Agent, or Firm*—Kriegsman & Kriegsman

[57] ABSTRACT

A method of fabricating a needle useful in the dispensing of plastic fasteners and a needle fabricated by the method. In a preferred embodiment, the method involves electroplating a nickel alloy onto a master, the master being made of a meltable material and being appropriately shaped to produce an unfinished shank portion of a needle. The master is then melted away from the electroplated metal, leaving behind an unfinished shank portion. The unfinished shank portion is then finished by machining, and a plastic base portion is insert-molded around the end thereof.

11 Claims, 3 Drawing Sheets

FABRICATION OF NEEDLES USEFUL IN THE DISPENSING OF PLASTIC FASTENERS

BACKGROUND OF THE INVENTION

The present invention is directed to a new and novel method of fabricating needles useful in the dispensing of plastic fasteners. The present invention is also directed to needles fabricated by said method.

Plastic fasteners of the type used to attach, for example; merchandising tags to articles of commerce are well-known in the art, as illustrated by the following commonly assigned patents: U.S. Pat. No. 3,103,666, issued Sep. 17, 1963; U.S. Pat. No. 4,121,487, Oct. 24, 1978; U.S. Pat. No. 4,456,161, issued Jun. 26, 1984; and U.S. Pat. No. 4,955,475, issued Sep. 11, 1990.

In many instances, the aforementioned plastic fasteners are fabricated in the form of continuously connected fastener stock, the fastener stock comprising a pair of elongated side members interconnected by a plurality of cross-links or filaments. Frequently, one side member comprises a plurality of T-bars joined together by severable connectors, and the other side member comprises a plurality of T-bars or paddles also joined together by severable connectors. Individual fasteners are usually dispensed from the fastener stock with the aid of a dispensing tool. Such dispensing tools typically include a needle through which the T-bar of a severed fastener is ejected into a desired article.

Such needles typically include a shank portion which has a relatively sharp tip to permit penetration of the desired article and a substantially cylindrical rear portion. The shank is hollow to permit the T-bar end of the fastener to pass therethrough and has a longitudinal slot to permit the filament of the fastener to extend therefrom as the T-bar end moves through the needle. The shank portion extends from a substantially cylindrical base having a central bore with an inner diameter equal to the inner diameter of the hollow shank. The base also has a longitudinal slot aligned with the slot in the shank. In needles which are removable from the dispensing tool, the base is provided with means for correctly positioning the needle within the tool and means for locking same into place.

Needles of the type described above are produced commercially using two different constructions. According to one construction, the base and shank are machined from a single piece of metal. This construction has high strength (due in part to the cross-sectional thickness of the needle), which is necessary for certain applications (see, e.g., the application discussed in commonly assigned U.S. Pat. No. 4,877,172, issued Oct. 31, 1989). However, as can readily be appreciated, the process of machining a single piece of metal into the required form is an arduous and time consuming task which results in a relatively expensive product.

According to the second construction, the needle comprises two separate pieces, a metal shank portion which is stamped from a flat sheet of metal and thereafter rolled into the desired configuration, and a plastic base portion which is molded around the end of the shank portion. This construction results in a needle which is considerably less expensive to manufacture than the all-metal, single-part first construction, but is not as thick as the first construction and is more susceptible to being damaged in use.

SUMMARY OF THE INVENTION

It is an object of the present invention to provide a new and novel method for fabricating a needle useful in the dispensing of plastic fasteners.

It is another object of the present invention to provide a method as described above which can be used to fabricate a needle of comparable strength and durability to conventional needles of the type machined from a single piece of metal.

It is still another object of the present invention to provide a method as described above which is less expensive than the conventional method of machining a needle from a single piece of metal.

Additional objects of the invention, as well as features and advantages thereof, will be set forth in part in the description which follows, and in part will be obvious from the description or may be learned by practice of the invention. The objects of the invention also may be realized and attained by means of instrumentalities and combinations particularly pointed out in the appended claims.

To achieve the objects broadly set forth above and in accordance with the teachings of the present invention, a method for fabricating a needle of the type useful in the dispensing of plastic fasteners is provided herein, said needle comprising a finished shank portion and a base portion, said method comprising the steps of (a) fabricating an unfinished shank portion by electroforming; (b) finishing said unfinished shank portion; and (c) forming a base portion around the end of said finished shank portion.

As can readily be appreciated, because the unfinished shank portion of the needle is produced by electroforming, its cross-sectional thickness can be carefully controlled by controlling the amount of metal electroplated. In this manner, high strength shank portions may be produced by permitting a comparatively high amount of metal to be electroplated (e.g., 0.015–0.020 inch in thickness as opposed to the 0.010 inch thickness commonly used in the fabrication of conventional stamped/rolled needles).

Preferably, the unfinished shank portion is finished by machining. As can readily be appreciated, the amount of machining required is substantially less than that required to machine an all-metal needle from a single sheet of metal in the conventional manner. Consequently, the present method is less costly than the conventional machining method.

In addition to being directed to a new and novel method of fabricating needles, the present invention is also directed to the needles themselves.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
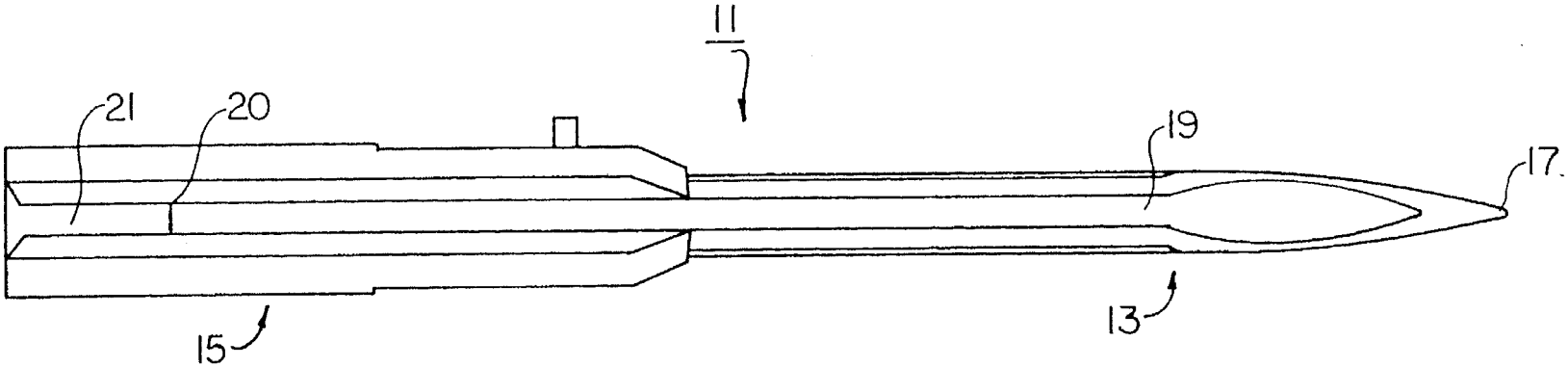
FIG. 1 is an enlarged top view of one embodiment of a needle adapted for use in the dispensing of plastic fasteners, the needle being constructed according to the teachings of the present invention.
Figure 2:
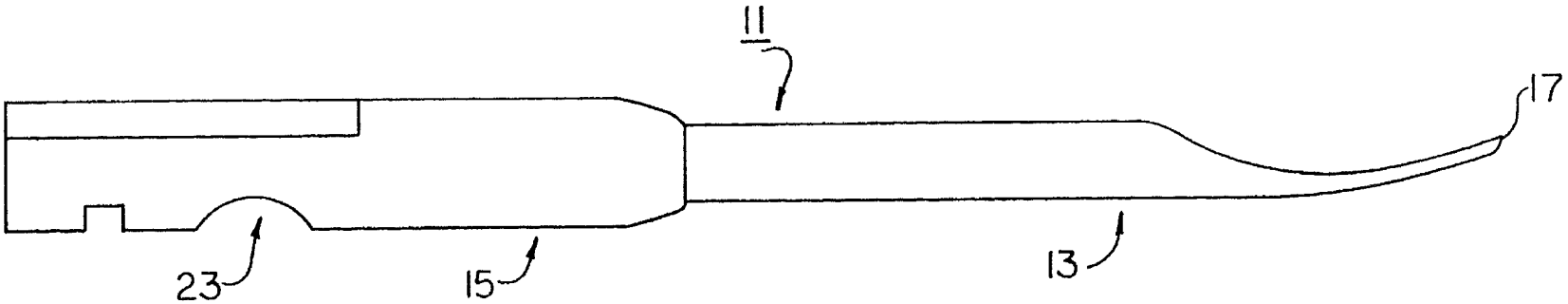
FIG. 2 is an enlarged left side view of the needle shown in FIG. 1.

Referring now to FIGS. 1 and 2, there are shown top and left side views, respectively, of a needle adapted for use in the dispensing of plastic fasteners, the needle being constructed according to the teachings of the present invention and being represented by reference numeral 11. Those portions of needle 11 not pertinent to the present invention are not shown and/or discussed.

Needle 11 comprises a shank portion 13 and a base portion 15. Shank portion 13, which is made in the manner to be described below, is elongated and substantially cylindrical over most of its length, the front end of shank portion 13 being shaped in the form of a relatively sharp tip 17 to permit penetration of a desired article. Shank portion 13 is hollow to permit the T-bar of a fastener to pass therethrough and includes a longitudinal slot 19 to permit the associated filament of a fastener to extend therethrough as the T-bar moves along.

Base portion 15, which may be a conventional base portion, is made in the conventional manner by insert-molding plastic onto the rear end 20 of shank portion 13. Base portion 15 is hollow and generally cylindrical in shape and includes a longitudinal slot 21 aligned with longitudinal slot 19 of shank portion 13. Base portion 15 is provided with means 23 for correctly positioning needle 11 within a fastener dispensing tool and for locking same into place.

Figure 3A:
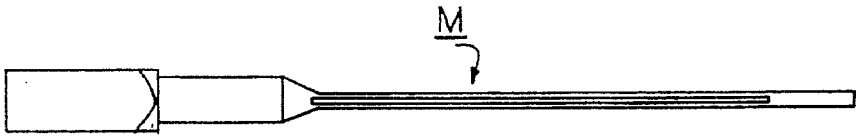
FIGS. 3(*a*) and 3(*b*) are enlarged top and left side views, respectively, of a master used in the fabrication of the shank portion of the needle shown in FIG. 1.
Figure 3B:
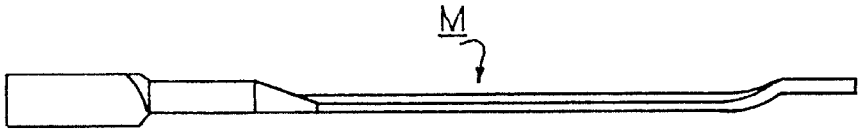
Figure 6A:
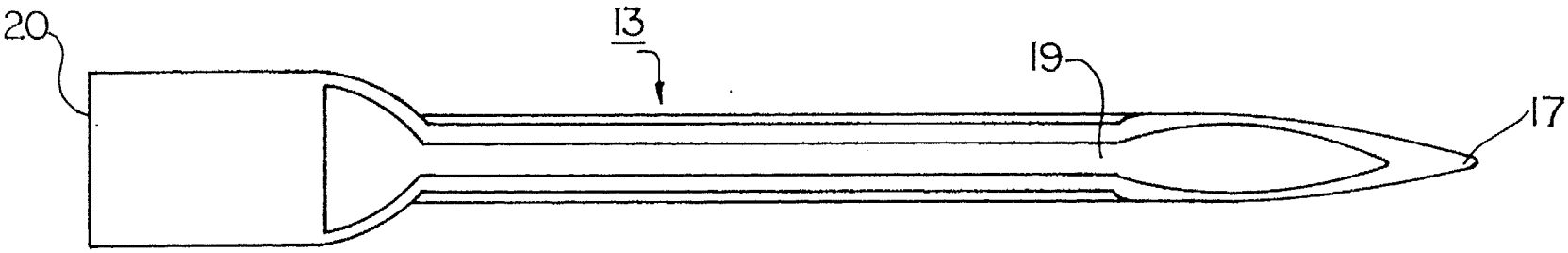
FIGS. 6(*a*) and 6(*b*) are enlarged top and left side views, respectively, of a finished shank portion produced by machining the unfinished shank portion in FIGS. 5(*a*) and 5(*b*).
Figure 6B:
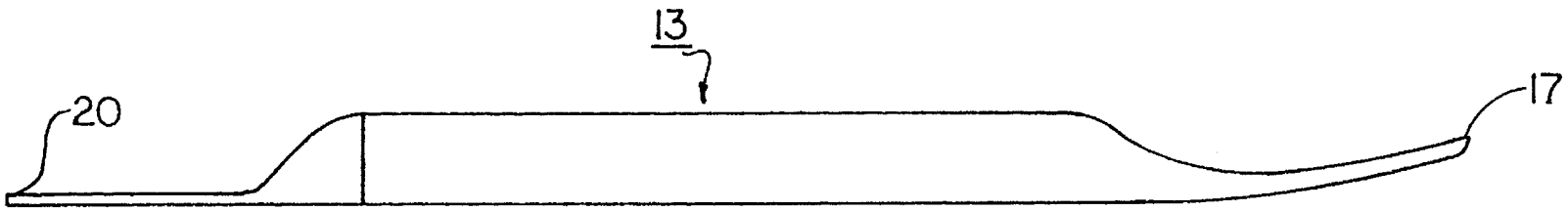

Referring now to FIGS. 3(*a*) and 3(*b*) through FIGS. 6(*a*) and 6(*b*), there is represented the sequence of steps by which shank portion 13 is fabricated in accordance with the method of the present invention. More specifically, in FIGS. 3(*a*) and 3(*b*), there are shown top and left side views, respectively, of an electroforming substrate or master M used to make an unfinished shank portion. Master M is made of a meltable substance and is preferably made of an inexpensive, dimensionally-stable, accurately reproducible, injection molded plastic, such as styrene.

Figure 4A:
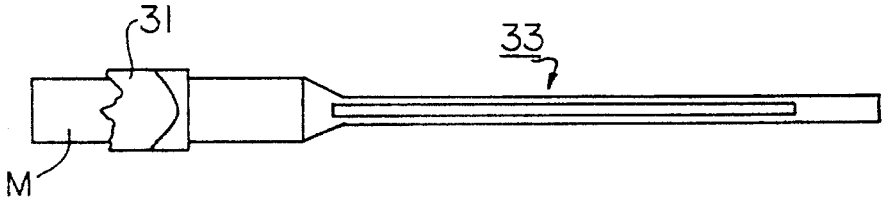
FIGS. 4(*a*) and 4(*b*) are enlarged top and left side views, respectively, of the master shown in FIGS. 3(*a*) and 3(*b*) after an electroplating of metal has been coated thereonto.
Figure 4B:
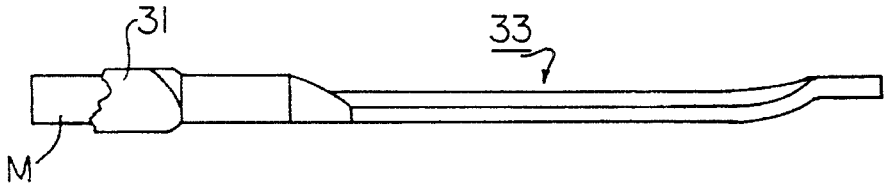
Figure 5A:
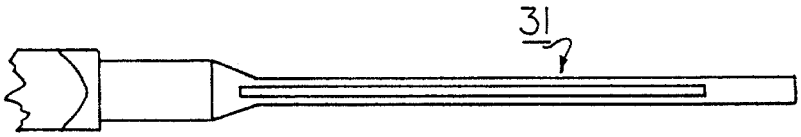
FIGS. 5(*a*) and 5(*b*) are enlarged top and left side views, respectively, of an unfinished shank portion produced by melting away the master of FIGS. 4(*a*) and 4(*b*) from the electroplated metal coated thereonto.
Figure 5B:
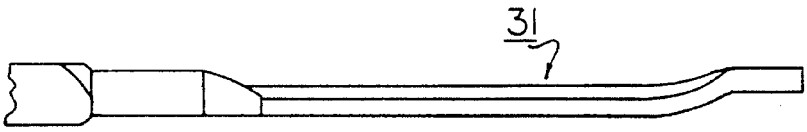

Master M is used in the conventional electroforming manner to form an unfinished shank portion, an example of which is shown separately in FIGS. 5(*a*) and 5(*b*) and represented by reference numeral 31. More specifically, master M is first electroplated with a suitable metal, such as a nickel alloy, until a metal coating of sufficient thickness has been deposited on master M (see FIGS. 4(*a*) and 4(*b*) where master M and unfinished shank portion 31 are collectively represented by the reference numeral 33). For high durability/special purpose needles (e.g., needles of the type used in applications such as in U.S. Pat. No. 4,877,172), a thickness of 0.015–0.020 inch is preferred. However, as can readily be appreciated, virtually any desired thickness can be obtained by controlling the amount of metal electroplated on master M.

Master M is then melted away from the metal electroplated thereonto, leaving behind unfinished shank portion 31.

Unfinished shank portion 31 is then appropriately machined to yield shank portion 13 (see FIGS. 6(*a*) and 6(*b*)). As can readily be appreciated, because unfinished shank portion 31 has a similar overall shape to shank portion 13, less machining is required to finish unfinish shank portion 31 than would be required to machine shank portion 13, ab initio, from a flat sheet of metal.

It is to be understood that the particular shape, design and structure of needle 11 are illustrative only.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A method of fabricating a needle of the type useful in the dispensing of plastic fasteners, said needle comprising a finished shank portion and a base portion, said finished shank portion being a hollow cylindrical member having a sharp tip, a longitudinal slot and a rear end, said method comprising the steps of:

(a) fabricating an unfinished shank portion, said fabricating step comprising electroforming a metal onto a master;

(b) finishing said unfinished shank portion by machining the metal electroformed on the master; and (c) forming a base portion around the rear end of said finished shank portion.

2. The method as claimed in claim 1 wherein said finishing step comprises machining a longitudinal slot and a sharp tip into said unfinished shank portion.

3. The method as claimed in claim 1 wherein said forming step comprises insert molding a plastic base portion around the end of said finished shank portion.

4. The method as claimed in claim 1 wherein said master is an inexpensive, dimensionally-stable, accurately reproducible, injection molded plastic and wherein the metal is a nickel alloy.

5. The method as claimed in claim 4 wherein said electroforming step comprises electroplating the nickel alloy onto said master to a thickness of approximately 0.015–0.020 inch.

6. A needle fabricated by the method of claim 5.

7. The method as claimed in claim 1 wherein said fabricating step further comprises removing said unfinished shank portion from said master.

8. A method of fabricating a finished shank portion of a needle of the type useful in the dispensing of plastic fasteners, said finished shank portion being a hollow cylindrical member having a sharp tip, a longitudinal slot and a rear end, said method comprising the steps of:

(a) fabricating an unfinished shank portion, said fabricating step comprising electroforming a metal onto a master; and (b) finishing said unfinished shank portion, said finishing step comprising machining a sharp tip and a longitudinal slot into said unfinished shank portion.

9. The method as claimed in claim 8 wherein said fabricating step further comprises removing said unfinished shank portion from said master.

10. The method as claimed in claim 8 wherein said electroforming step comprises electroforming a nickel alloy onto said master to a thickness of approximately 0.015–0.020 inch.

11. A finished shank portion fabricated by the method of claim 10.

* * * * *